US006357528B1

(12) United States Patent
Davis et al.

(10) Patent No.: US 6,357,528 B1
(45) Date of Patent: Mar. 19, 2002

(54) ONE-TRIP CASING CUTTING & REMOVAL APPARATUS

(75) Inventors: John Phillip Davis, Cypress; David Blair Haughton, Houston, both of TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 09/539,104

(22) Filed: Mar. 30, 2000

Related U.S. Application Data

(60) Provisional application No. 60/127,775, filed on Apr. 5, 1999.

(51) Int. Cl.[7] ..... E21B 29/00

(52) U.S. Cl. ..... 166/339; 166/298; 166/55.8; 166/361; 166/98; 294/86.27; 294/86.28

(58) Field of Search ..... 166/55, 55.6–55.8, 166/98, 298, 339, 351, 361, 301; 294/86.26–86.28, 86.3, 86.31, 86.34

(56) References Cited

U.S. PATENT DOCUMENTS

| | | | |
|---|---|---|---|
| 1,867,289 A | | 7/1932 | Ventresca |
| 2,117,050 A | | 5/1938 | Wilson |
| 2,640,537 A | | 6/1953 | Edwards |
| 4,047,568 A | | 9/1977 | Aulenbacher |
| 4,703,802 A | * | 11/1987 | Bryan et al. |
| 4,969,514 A | | 11/1990 | Morris et al. |
| 5,253,710 A | | 10/1993 | Carter et al. |
| 5,318,115 A | | 6/1994 | Rouse |
| 6,029,745 A | * | 2/2000 | Broussard et al. |

FOREIGN PATENT DOCUMENTS

| | | |
|---|---|---|
| EP | 0155129 A2 | 9/1985 |
| GB | 2165286 A | 4/1986 |
| GB | 2259930 A | 3/1993 |
| GB | 2307932 A | 6/1997 |
| GB | 2327691 A | 2/1999 |
| GB | 2334276 A | 8/1999 |

* cited by examiner

*Primary Examiner*—Roger Schoeppel
(74) *Attorney, Agent, or Firm*—Steve Rosenblatt

(57) ABSTRACT

A one-trip system for removing casing from a wellhead is described. The string includes a cutting device spaced at the required depth and a grappling device above it at the appropriate location. A swivel tool, such as a marine swivel, is used in conjunction with a seal-pulling assembly so that after cutting the casing, the seal assembly can be pulled without an additional trip into the well. The grappling device or spear can be hydraulically actuated to grab the casing for removal from the wellbore. The spear features a drop-in restrictor which allows sufficient flow during cutting operations with a mechanical cutter without actuating the spear, while at the same time allowing actuation of the spear by circulation after dropping in the restrictor after the casing section has been cut.

16 Claims, 3 Drawing Sheets

ONE-TRIP CASING CUTTING & REMOVAL APPARATUS

This application is a continuation of provisional application 60/127,775 filed Apr. 4, 1999 and requests priority under 35 U.S.C. 119(e).

FIELD OF THE INVENTION

The field of this invention relates to techniques for cutting and removing casing in a single trip, particularly through subsea wellheads.

BACKGROUND OF THE INVENTION

Typical completions involve multiple casing sizes concentrically mounted and supported in a wellhead, with each section having a seal assembly in the wellhead. Govenment regulations require removal of wellheads when the well is no longer in service. Procedures for accomplishing the removal of the wellhead would involve an initial trip to cut the innermost section of casing using a marine swivel which is supported by the wellhead. The marine swivel allows the string with a cutter to rotate while the exterior of the swivel remains stationary so that it can be supported by the wellhead. At the conclusion of this step with the innermost section of casing cut, the cutter is removed and the seal puller is installed. It is run into the wellbore for a second trip to pull the seal for the innermost casing. Thereafter, a third trip is made with a spear to grab the cut casing segment and bring it up out of the well to the surface. This procedure can be repeated to then remove the next casing section that is exposed. Each time the seal puller needs to be a different size to accommodate the specific casing section being removed. In the event all the casing sections are to be cut, the removal of the seals for each casing size is not necessary since they will all be removed together.

There are several known spear designs on the market, such as those now produced by Baker Oil Tools and referred to as type B, C, D or E. These designs have exposed grapples so that if they are rotated, they will tend to come out radially. Accordingly, such known prior designs of spears could not be combined with a single- or multiple-string cutter because they would snag in the casing as the cutter tried to rotate.

Designs of marine swivels are also known. One such product is made by Baker Oil Tools and identified as product No. 170-01. These marine swivels can be adapted to support a seal-pulling assembly of different sizes to accommodate the sequential removal of casing sections from the wellbore in discrete 3-trip operations in the prior art.

The limitations of some of the spears of the prior art also included a weight-set feature which would make them sling out with the application of centrifugal force. This, again, would detract from their use in conjunction with any kind of cutter involving rotation.

Accordingly, the objects of the invention are to reduce rig time, thug saving the well owner significant quantities of money by making in one trip what has previously been done in the prior art in three trips. Another object of the invention is to combine in one string a cutter of whatever type, a spear of whatever type, and seal puller of whatever type so that in one trip with these components properly spaced out, the casing section or sections can be cut, the seal assembly pulled, and the casing section grappled for removal. Another object of the invention is to improve the cutting technique with an improved actuation system for a multiple string cutter which involves longitudinal piston movement moving the cutter in an arcuate motion outwardly for the cut.

Another objective is to provide wear surfaces on the cutter elements so that they can be redressed for reuse. Another objective is to provide improved stabilizers which are hydraulically actuated in the preferred embodiment to improve the cutting speed and precision. Yet another objective of the present invention is to design the spear so that the gripping members or slips are protected and cannot engage the casing as the cutter is rotated.

These objectives of the present invention will become more readily apparent to those skilled in the art from a review of the preferred embodiment described below.

SUMMARY OF THE INVENTION

A one-trip system for removing casing from a wellhead is described. The string includes a cutting device spaced at the required depth and a grappling device above it at the appropriate location. A swivel tool, such as a marine swivel, is used in conjunction with a seal-pulling assembly so that after cutting the casing, the seal assembly can be pulled without an additional trip into the well. The grappling device or spear can be hydraulically actuated to grab the casing for removal from the wellbore. The spear features a drop-in restrictor which allows sufficient flow during cutting operations with a mechanical cutter without actuating the spear, while at the same time allowing actuation of the spear by circulation after dropping in the restrictor after the casing section has been cut.

DETAILED DESCRIPTION OF THE PREFERRED EMBODIMENT

Figure 1:
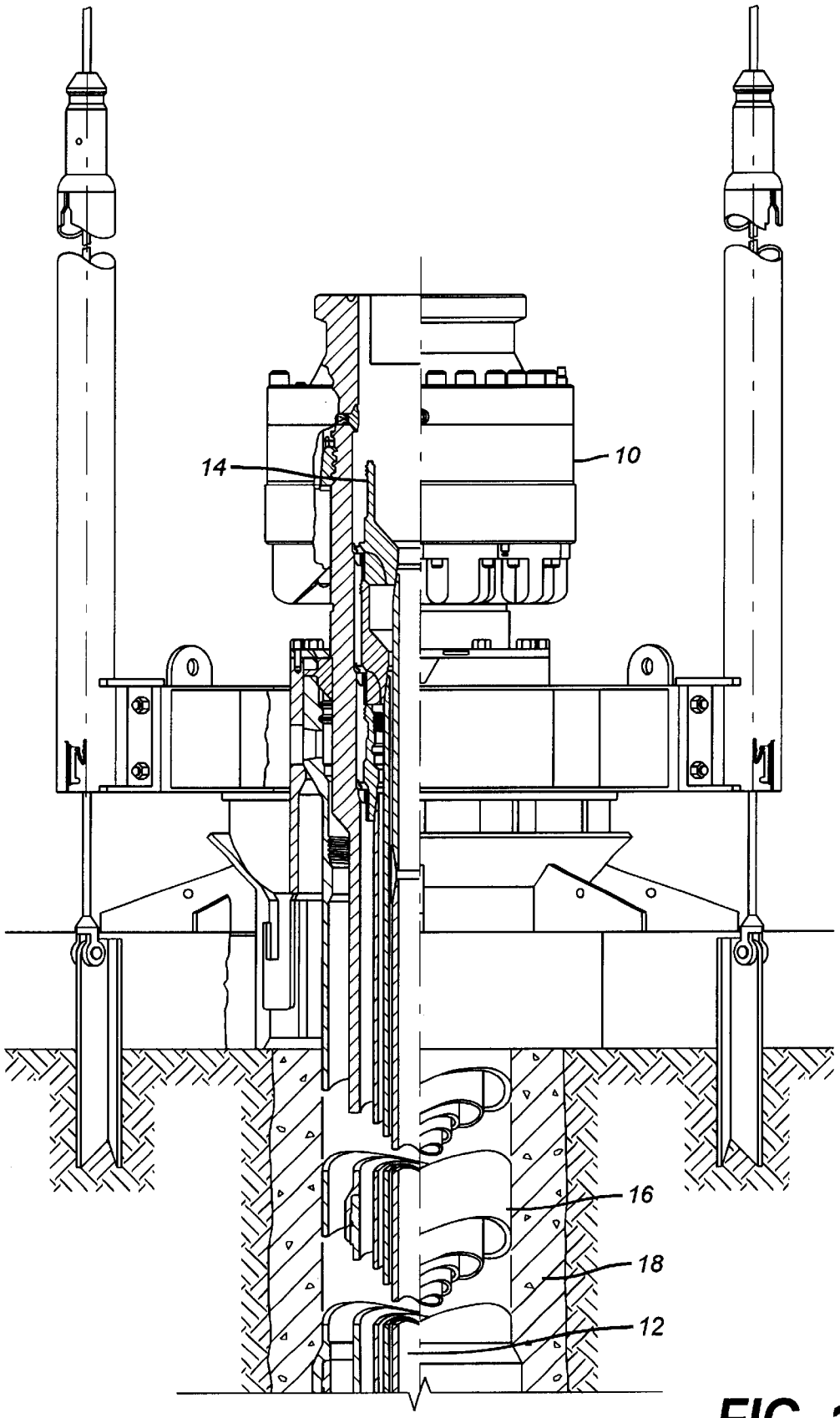
FIG. 1 is a sectional elevation of a typical wellhead installation, showing multiple concentrically mounted casing strings.
Figure 2:
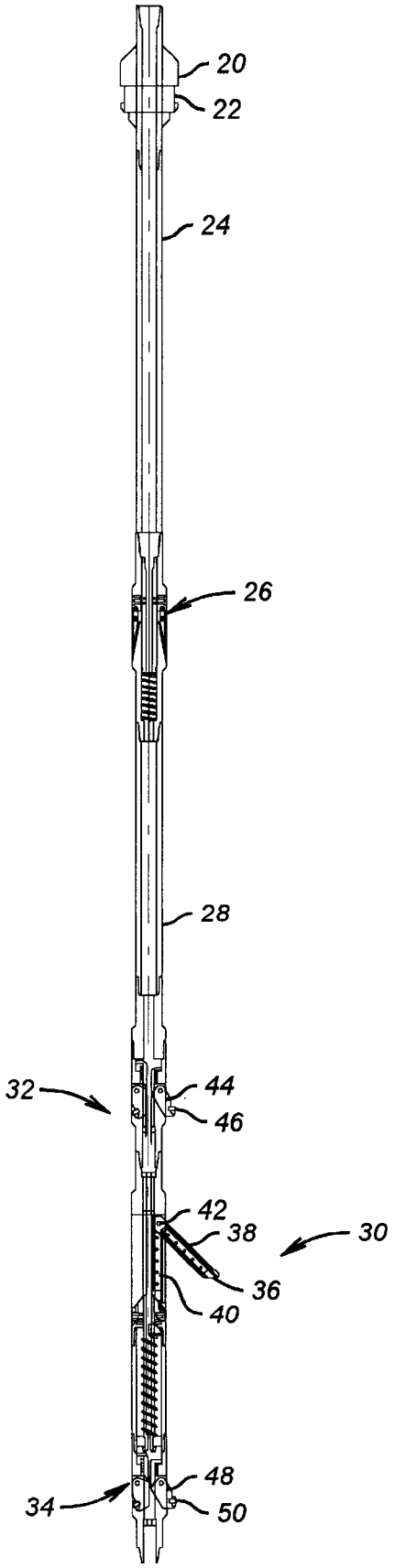
FIG. 2 is a sectional elevational view of the one-trip assembly used for cutting and removal of casing sections from the wellhead.

FIG. 1 illustrates a typical known wellhead assembly, showing a subsea wellhead 10. FIG. 1 further illustrates the concentrically mounted casing string starting with casing string 12, which is the smallest. A seal assembly 14 secures the casing string 12 in the wellhead 10. The other strings are similarly situated, with their own seal assemblies. In FIG. 1, the outermost section of casing 16 is cemented with cement 18. In between some of the other casing strings can be cemented as well. FIG. 2 illustrates the assembly used for one-trip removal of one or more strings, as illustrated in FIG. 1. The first string to be removed from the assembly in FIG. 1 is casing string 12. The assembly to do this in one trip is shown in FIG. 2.

The assembly comprises a marine swivel 20 of known construction. Optionally attachable to it is a seal puller 22. Both the marine swivel 20 and the seal puller 22 are known designs. Below the seal puller 22 is a section of tubing 24 to properly space out the spear 26. The spear 26 is shown in more detail in FIG. 3. Below the spear 26 is another section of tubing 28 to properly space out the cutter 30. The cutter 30 has a stabilizer 32 above and 34 below.

In the preferred embodiment shown in FIG. 2, the cutter 30 has multiple blades, one of which 36 is shown in FIG. 2. The blades can have renewable cutting surfaces 38. A piston 40, which is hydraulically actuated, engages the blades 36 and forces them to rotate about their respective pivot pins 42. Hydraulic pressure also forces out arms 44 on stabilizer 32. Each of the arms 44 has a roller 46 to engage the casing while the entire string rotates with respect to the marine swivel 20.

The lower stabilizer 34 is built the same as the upper stabilizer 32 and operates by hydraulic actuation to move out arms 48 until their rollers 50 engage the casing.

Figure 3:
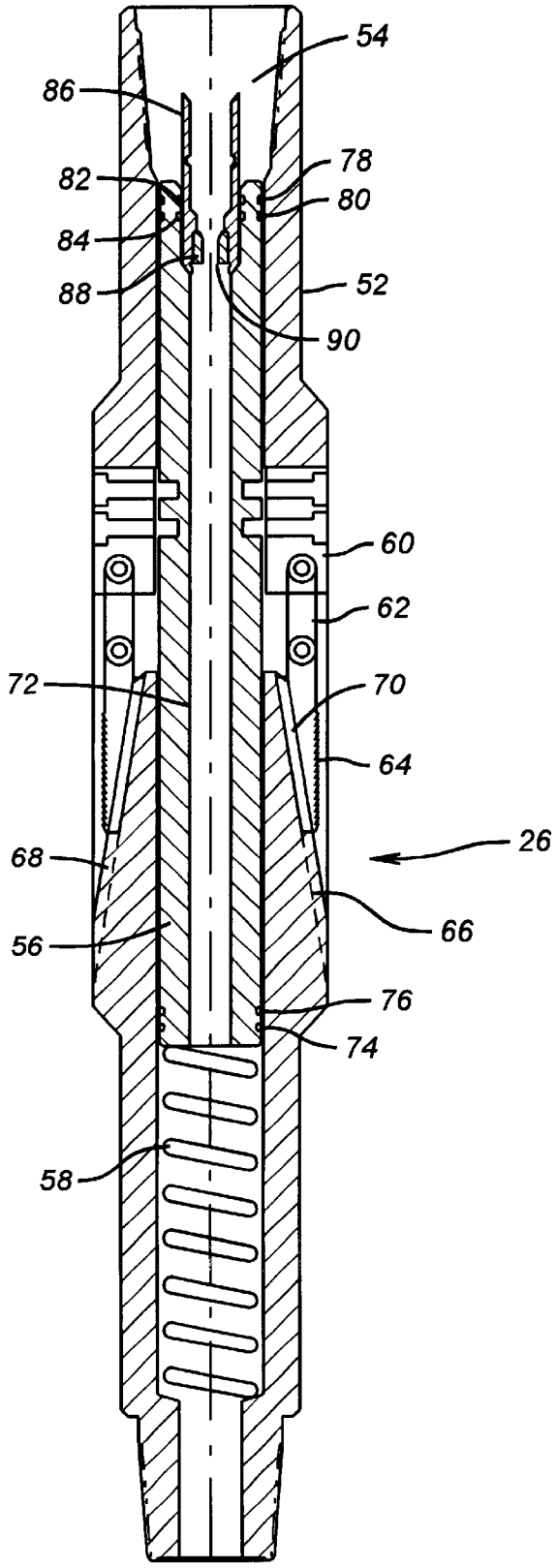
FIG. 3 is a detailed view of the spear of the preferred embodiment, shown in sectional elevation.

The operation of the spear is illustrated in FIG. 3. It has a body 52 and a bore 54. A piston 56 acts against a spring 58 within bore 54. Attached to the piston 56 is a sleeve 60 to which are attached slips 62, each of which has a gripping surface 64. Body 52 has a tapered conical segment 66 which has opposed grooves 68 which are for the purpose of retaining tabs 70 on slips 62. Thus, despite the fact that the body 52 rotates, centrifugal force will not allow the slips 62 to come out radially. The slips 62 are also protected by being held in the retracted position by virtue of their tabs 70 extending in groove 68 of the conical segment 66 of body 52.

Piston 56 has an internal bore 72. Normally this bore is large enough so that flow rates anticipated for use in actuating the stabilizers 32 and 34 and actuating the blades 36 will not cause the piston 56 to move downwardly against the opposing force of spring 58. Piston 56 is sealed in bore 54 by seals 74, 76, 78 and 80. Bore 72 has seals 82 and 84 adjacent seals 78 and 80 near the upper end. A drop-in restrictor 86 has a narrow renewable sleeve 88 which has a bore 90. With the drop-in restrictor 86 seated against seals 82 and 84, flow then has to go through the narrow bore 90. With sufficient flow through bore 90, the force of spring 58 is overcome and the piston 56 is pushed downwardly, forcing the slips 62 down the conical segment 66. This moves the gripping surfaces 64 into contact with the casing. Once the gripping surfaces 64 are in contact with the casing, further flow is no longer required to hold the casing with the spear 26. Alternative spear designs are also within the spirit of the invention.

Accordingly, those skilled in the art can now readily see how the cutting of a casing segment supported in a wellbore can be accomplished in a single trip. The string shown in FIG. 2 properly spaces out the key components which are the marine swivel 20, the spear 26, and the cutter 30. The seal puller 22 is secured to the underside of the marine swivel 20. If all of the strings are being cut and removed at the same time, the seal puller 22 can be omitted. In operation, the method of the present invention involves lowering the string shown in FIG. 2 into the casing and commencing flow after the marine swivel 20 comes to rest on the wellhead. Flow actuates the piston 40 to move the blades 36 pivotally about pivots 42. Rotation of the assembly through the marine swivel 20 allows the cutting surfaces 38 to cut through one or more casing layers. While the cutting is going on, the arms 44 and 48 extend outwardly due to the flow through the assembly such that rollers 46 and 50 stabilize the cutting operation with the cutting surface 38. At the conclusion of the cutting of the casing string or strings, the seal assembly 14 is grabbed by the seal puller 22 and removed. The drop-in insert 86 is inserted into sealing contact with seals 82 and 84. Further flow then creates a backpressure sufficient to overcome the force of spring 58 to downwardly shift the piston 56. Downward shifting of piston 56 results in outward movement of the gripping surfaces 64 on slips 62 until contact with the innermost casing string is made. An upward force on the assembly then allows removal of the cut casing string.

Those skilled in the art will appreciate that other cutting devices can be used, and the cut can be made chemically or explosively or by other known techniques. The advantage of the present invention is that what previously took three trips into the well now can be done in a single trip. The spear design 26 is unique in that it resists outward movement of the slips 62 when being rotated during the casing cutting operation with the cutter 30. The stabilizer design is new and improved in that the arms are hydraulically actuated with a piston which longitudinally moves in response to fluid pressure or flow. The arms 44 and 48 can flex to handle imperfections or out-of-roundness in the casing being cut and to better centralize the cutter 30.

The foregoing disclosure and description of the invention are illustrative and explanatory thereof, and various changes in the size, shape and materials, as well as in the details of the illustrated construction, may be made without departing from the spirit of the invention.

What is claimed is:

1. A casing and removal assembly for use with multiple tubulars in a wellhead, comprising:

a cutter selectively engageable to a tubular exposed in the wellhead;

a spear to selectively grab a cut portion of the tubular after the cut is made for removal of the tubular from the wellhead;

a swivel to support said cutter and said spear off the wellhead while allowing them to rotate;

at least one spacer to properly position said cutter and said spear with respect to the tubular to be cut so that the tubular can be cut and removed in a single trip.

2. A casing and removal assembly for use with multiple tubulars in a wellhead, comprising:

a cutter selectively engageable to a tubular exposed in the wellhead;

a spear to grab a cut portion of the tubular for removal from the wellhead;

a swivel to support said cutter off the wellhead while allowing it to rotate;

a seal pulling assembly:

at least one spacer to properly position said cutter and said spear with respect to the tubular to be cut so that the tubular can be cut and removed in a single trip.

3. The assembly of claim 2, further comprising:

said seal pulling assembly is attached to said swivel.

4. The assembly of claim 1, wherein:

said cutter comprises at least one cutting blade which is actuable by at least one first piston.

5. A casing and removal assembly for use with multiple tubulars in a wellhead, comprising:

a cutter selectively engageable to a tubular exposed in the wellhead;

said cutter comprises at least one cutting blade which is actuable by at least one first piston;

at least one stabilizer for said cutter, said stabilizer comprises at least one arm moveable toward the tubular by at least one second piston;

a spear to grab a cut portion of the tubular for removal from the wellhead;

a swivel to support said cutter off the wellhead while allowing it to rotate;

at least one spacer to properly position said cutter and said spear with respect to the tubular to be cut so that the tubular can be cut and removed in a single trip.

6. The assembly of claim 5, wherein:

said first and second pistons are actuable by flow through said cutter and said stabilizer.

7. The assembly of claim 6, further comprising:

at least two said stabilizers disposed uphole and downhole of said cutter.

8. The assembly of claim 7, further comprising:

a flow passage through said spear which is sufficiently large so as to not actuate a spear piston operably secured to it when said first and second pistons are activated.

9. The assembly of claim 8, further comprising:

an insertable restriction into said flow passage in said spear for actuation of said spear piston;

said spear piston advancing at least one gripper toward the tubular.

10. The assembly of claim 9, wherein:

said gripper is cammed by said spear piston and further comprises tabs to resist outward movement responsive to rotation of said spear.

11. The assembly of claim 10, wherein:

said stabilizer comprises a plurality of arms pivotally mounted and activated by said second piston.

12. The assembly of claim 11, wherein:

said cutter comprises a plurality of cutting blades each mounted, removably to a cutting arm which is in turn pivotally mounted and activated by said first piston.

13. A casing and removal assembly for use with multiple tubulars in a wellhead, comprising:

a cutter selectively engageable to a tubular exposed in the wellhead;

a spear to grab a cut portion of the tubular for removal from the wellhead;

a passage through said cutter and said spear;

said cutter comprising at least one cutter blade, said cutter blade, in response to flow through said passage moves toward the tubular without any outward movement by said spear;

a swivel to support said cutter off the wellhead while allowing it to rotate;

at least one spacer to properly position said cutter and said spear with respect to the tubular to be cut so that the tubular can be cut and removed in a single trip.

14. A casing and removal assembly for use with multiple tubulars in a wellhead, comprising:

a cutter selectively engageable to a tubular exposed in the wellhead;

a spear to grab a cut portion of the tubular for removal from the wellhead;

a passage through said cutter and said spear;

said spear comprises a gripper which is urged by flow through said spear to move toward the tubular;

said gripper operable after a restrictor is inserted in said passage to apply a force to move said gripper;

said cutter comprising at least one cutter blade, said cutter blade, in response to flow through said passage moves toward the tubular before any response by said spear;

a swivel to support said cutter off the wellhead while allowing it to rotate;

at least one spacer to properly position said cutter and said spear with respect to the tubular to be cut so that the tubular can be cut and removed in a single trip.

15. The assembly of claim 14, wherein:

said gripper is secured to a biased piston and is mounted adjacent a camming surface, whereupon insertion of said restrictor, flow exerts a force on said biased piston to overcome said bias and cam said gripper along said camming surface.

16. The system of claim 15, wherein:

said gripper is retained to said camming surface against centrifugal force due to rotation.

* * * * *